US007731907B2

(12) United States Patent
Ballhorn et al.

(10) Patent No.: US 7,731,907 B2
(45) Date of Patent: Jun. 8, 2010

(54) DEVICE AND PROCESS FOR TESTING A SAMPLE LIQUID

(75) Inventors: Ilse Ballhorn, Dortmund (DE); Gert Blankenstein, Dortmund (DE); Ralf-Peter Peters, Bergisch-Gladbach (DE); Birgit Mueller-Chorus, Bochum (DE); Michael Schlueter, Maselheim (DE)

(73) Assignee: Boehringer Ingelheim microParts GmbH, Dortmund (DE)

( * ) Notice: Subject to any disclaimer, the term of this patent is extended or adjusted under 35 U.S.C. 154(b) by 1037 days.

(21) Appl. No.: 11/279,030

(22) Filed: Apr. 7, 2006

(65) Prior Publication Data

US 2007/0189927 A1 Aug. 16, 2007

(30) Foreign Application Priority Data

Apr. 9, 2005 (DE) ..... 10 2005 016 503
Apr. 9, 2005 (DE) ..... 10 2005 016 509
Sep. 7, 2005 (DE) ..... 10 2005 042 601

(51) Int. Cl.
*B01L 3/02* (2006.01)

(52) U.S. Cl. ..... 422/100; 422/57; 422/58; 422/101; 422/102; 422/61; 435/287.2; 435/288.3; 436/177; 436/180

(58) Field of Classification Search ..... None
See application file for complete search history.

(56) References Cited

U.S. PATENT DOCUMENTS 5,061,446 A 10/1991 Guigan
5,869,004 A 2/1999 Parce et al.
6,004,515 A 12/1999 Parce et al.
6,063,589 A 5/2000 Kellogg et al.
6,082,185 A 7/2000 Saaski
6,143,247 A 11/2000 Sheppard, Jr. et al.
6,162,400 A 12/2000 Schembri
6,582,662 B1 6/2003 Kellogg et al.
6,706,519 B1 3/2004 Kellogg et al.

(Continued)

FOREIGN PATENT DOCUMENTS

WO 00/78455 A1 12/2000

(Continued)

OTHER PUBLICATIONS

Design of a Compact Disk-Like Microfluidic Platform for Enzyme-Linked Immunosorbent Assay, Siyi Lai et al., Analytical Chemistry, vol. 76, No. 7, Apr. 1, 2004, pp. 1832-1837.

*Primary Examiner*—Jill Warden
*Assistant Examiner*—Sally A Sakelaris
(74) *Attorney, Agent, or Firm*—David S. Safran; Roberts Mlotkowski Safran & Cole, P.C.

(57) ABSTRACT

A device and a process for testing a sample liquid in which especially the ELISA process can be carried out very easily, rapidly and with high precision. To do this, a sample liquid and a dilution liquid are each supplied to several metering chambers of different volumes, so that the sample liquid can be diluted into assigned reaction chambers in one dilution step in different dilution ratios. Different liquids can be supplied in succession to the reaction chambers by means of a common receiving chamber. The liquids are transferred from the reaction chambers into the assigned test chambers to stop the detection reaction.

17 Claims, 3 Drawing Sheets

U.S. PATENT DOCUMENTS

| | | | | |
|---|---|---|---|---|
| 6,717,136 | B2 | 4/2004 | Andersson et al. | |
| 6,719,682 | B2 | 4/2004 | Kellogg et al. | |
| 6,764,818 | B2 | 7/2004 | Lafferty | |
| 6,776,965 | B2 | 8/2004 | Wyzgol et al. | |
| 6,880,576 | B2 | 4/2005 | Karp et al. | |
| 7,036,917 | B2 | 5/2006 | Müller-Chorus et al. | |
| 7,125,711 | B2 | 10/2006 | Pugia et al. | |
| 7,134,453 | B2 | 11/2006 | Peters et al. | |
| 2002/0187560 | A1 | 12/2002 | Pezzuto et al. | |
| 2003/0059343 | A1 | 3/2003 | Anderson | |
| 2003/0077204 | A1 | 4/2003 | Seki et al. | |
| 2003/0166265 | A1 | 9/2003 | Pugia et al. | |
| 2003/0198576 | A1 * | 10/2003 | Coyne et al. | 422/100 |
| 2004/0096358 | A1 | 5/2004 | Blankenstein et al. | |
| 2004/0120856 | A1 | 6/2004 | Andersson et al. | |
| 2004/0180377 | A1 | 9/2004 | Manger et al. | |
| 2004/0203136 | A1 | 10/2004 | Kellogg et al. | |
| 2004/0209381 | A1 | 10/2004 | Peters et al. | |
| 2004/0241051 | A1 | 12/2004 | Wyzgol et al. | |

FOREIGN PATENT DOCUMENTS

| | | | |
|---|---|---|---|
| WO | 02/083310 | A2 | 10/2002 |
| WO | 03/072254 | A1 | 9/2003 |
| WO | 03/093802 | A1 | 11/2003 |
| WO | 2004/004906 | A1 | 1/2004 |
| WO | WO 2004/004906 | * | 1/2004 |
| WO | 2004/058406 | A2 | 7/2004 |

* cited by examiner

DEVICE AND PROCESS FOR TESTING A SAMPLE LIQUID

BACKGROUND OF THE INVENTION

1. Field of the Invention

The invention relates to a device and a process for testing a sample liquid, especially by means of the ELISA process. In particular, this invention is concerned with microfluidic systems or devices with structures which have a size from roughly 1 to 1000 mm and/or cavities with a volume from roughly 1 to 1000 ml each. The following statements apply to devices and processes in which capillary, pressure and/or centrifugal forces act and are especially decisive for operation.

2. Description of Related Art

The term "ELISA" is an English language acronym for "enzyme-linked immunosorbent assay." In respect to this invention, this term should be understood in the sense of a process in which an enzyme is bound to an analyzed substance, especially to a complex of an analyzed substance and an antibody. By means of the enzyme, in a detection reaction, a substrate is modified or converted into a detection substrate, especially a fluorescing substrate or the like. A quantitative determination of the analyzed substance in the sample liquid is possible by recording the detection substrate. In order to enable high precision and a corresponding measurement range, conventionally, a dilution series of the sample liquid is studied in this way.

To date, the ELISA process has usually been carried out manually or automatically, for example, by means of pipetting robots, on an open pipetting plate with, for example, 96 open receiving chambers. The sample liquid to be tested is repeatedly diluted in succession in the receiving chambers in order to achieve different dilution conditions. Then, the sample liquid is pipetted with different dilution ratios into prepared receiving chambers in which the analyzed substance in the sample liquid can be bound to immobilized antibodies. After a relatively long reaction time, repeated flushing with a washing liquid takes place. Then, an enzyme bonded to a detection antibody is added. The detection antibody binds to a complex consisting of an analyzed substance and an immobilized antibody. Then again, different washing steps are necessary. Then, a substrate is added which is modified or converted by the enzyme into a detection substrate. The detection reaction is very time critical. The detection reaction is stopped, for example, by adding acid. The problem is that this cannot take place at the same time in all receiving chambers in which the detection reaction proceeds, and that, for greater volumes, different delays can occur due to diffusion and/or mixing processes. Finally, the detection substrate is determined, for example, optically, especially by fluorescence measurement or the like. The concentration of the analyzed substance in the sample liquid can be determined from the determined values.

The explained process is very complex and fault-susceptible. In particular, inaccuracies add up due to the host of individual steps. Furthermore, preparation of the receiving chambers for immobilization of the antibody is accordingly complex and is likewise associated with the use of large amounts of liquid. Moreover, the reactions often proceed very slowly due to the large amounts of liquid, and accordingly, large diffusion paths, so that the ELISA process in the form which has been conventional to date is very time-consuming.

The article "Design of a Compact Disk-like Microfluidic Platform for Enzyme-Linked Immunosorbent Assay" by Siyi Lai et al., Analytical Chemistry, Vol. 76, no, 7, Apr. 1, 2004, pp. 1832 to 1837, describes a microfluidic system in the form of a so-called compact disk (CD) for individual ELISA process steps. A sample liquid, a washing liquid, a liquid with a detection antibody and a substrate liquid are added to corresponding receiving chambers, which are routed in succession by the correspondingly varied rotation of the CD into a single assigned reaction chamber for the corresponding reaction. Thus, individual steps can be carried out in the microfluidic system. However, the pipetting effort is not significantly reduced, since compared to the conventional ELISA process, only the repeated washing steps were avoided.

In general, a host of microfluidic systems in the form of CDs are known, in which the liquid flows are controlled by rotation of the CD, therefore by centrifugal forces.

International Patent Application Publications WO 03/018198 A1 (U.S. Pat. Nos. 6,653,625; 6,717,136 and others), WO 03/072257 A1 (U.S. Pat. No. 6,764,818) and WO 2004/061414 A2 (U.S. Patent Application Publication 2004/121450) disclose microfluidic devices in which a liquid, especially a sample liquid, can be routed from a receiving chamber into connected chambers and can be divided into defined individual amounts and/or can be mixed and preferably react with another liquid. Similar microfluidic systems are also known from U.S. Pat. Nos. 6,705,519 and 6,719,682, U.S. Patent Application Publication 2004/0203136 A1, and International Patent Application Publications WO 00/78455 A1 (U.S. Pat. No. 6,706,519) and WO 01/87485 A2 (U.S. Patent Application Publications 2003/232403 and 2002/151078).

U.S. Patent Application Publication 2004/0203136 A1 discloses a process and a device for testing and diluting samples and reaction liquids. Several metering channels are connected via a common channel to a first receiving chamber for a sample and can be filled with the sample. Furthermore, a second receiving chamber for a dilution liquid is connected to a common channel, and thus, to metering channels. With correspondingly strong rotation, the dilution liquid is routed via the common channel into the metering channels so that the metered sample amounts are transferred into the following mixing chambers which are finally filled completely by the dilution liquid which flows afterward. This does not allow optimum or versatile dilution.

SUMMARY OF THE INVENTION

The object of this invention is to devise a device and a process for studying a sample liquid, economical, high-speed and/or accurate quantitative testing, especially by means of the ELISA process, being enabled.

This object is achieved by a device or by a process in accordance with the present invention as described below.

One aspect of this invention is to provide several first metering chambers for preferably exclusive reception of a sample liquid from a first common receiving chamber and several second metering chambers for preferably exclusive reception of a dilution liquid from a second common receiving chamber. The first and/or the second metering chambers vary in their volumes. The first and second metering chambers are assigned to one another in pairs and are each connected to an assigned reaction chamber so the volumes of sample liquid and dilution liquid contained in the first and second metering chambers can be transferred into the respectively assigned reaction chamber and mixed by pressure and/or centrifugal forces, by which the sample liquid is diluted with different dilution ratios. This dilution in accordance with the invention is hereinafter also called "parallel dilution" for short. Thus, with minimum pipetting cost—only the first and second common receiving chambers are filled from the outside with liquids—a dilution series of the sample liquid can be implemented with very high precision.

In particular, with the dilution according to the invention, the inaccuracies or errors which arise by using common channels or the like in the prior art, such as U.S. Patent Application Publication 2004/0203136 A1, are avoided. The metering of the first and second liquid takes place, specifically, independently of one another so that subsequent errors which occur otherwise in the metering are avoided. Furthermore, the first and second metering chambers are connected, preferably via separate channels, to the first and second receiving chambers so that no undefined pre-mixtures, impurities or mixing errors occur.

Another advantage compared to the prior art, such as U.S. Patent Application Publication 2004/0203136 A1, lies in that the two liquids are mixed, first in the respective reaction chamber—therefore quickly and specifically and/or under defined conditions—so that, for example, high-speed reactions can proceed in a defined manner. In particular, the liquids from the first and second metering chambers can be transferred into the reaction chambers at the same time or in succession and mixed.

Especially preferably, the volumes of the first and second metering chambers vary oppositely. When the metering chambers are located, for example, in two series which run next one another or in parallel, the volume of the first metering chambers increases in one direction (especially alternately in or against the filling direction), while the volume of the second metering chambers decreases in this direction. Thus, for a small space requirement and at low liquid volumes, a dilution series can be implemented over a large dilution area.

Preferably, the individual sums of the pertinent pairs of the first and second metering chambers are the same. This is beneficial for optimum space utilization, especially on a CD. Furthermore, the volumes of the diluted sample liquid with different dilution ratios are the same such that, accordingly, the other following cavities, especially reaction chambers and the like, can all be designed uniformly for the same volumes, by which the design is simplified and made uniform.

According to one preferred embodiment, a single parallel dilution is sufficient to cover a relatively large dilution area. However, if necessary, even after the first parallel dilution, at least another, preferably likewise parallel dilution can take place. This underdilution can, for example, take place only for an amount of sample liquid which is diluted with the largest dilution ratio. However, if necessary, also several or all liquid volumes of variously diluted sample liquid produced by the first parallel dilution can be subjected to a separate, further, especially likewise parallel dilution.

Preferably, the dilution liquid supplied or used for the first dilution is used for further dilution. Then, it is not necessary to supply dilution liquid again, by which handling is simplified, especially the required pipetting of the liquids is minimized.

According to another aspect of this invention, which can also be independently implemented, there is a third common receiving chamber for several reaction chambers. In particular, several liquids can be supplied in the receiving chamber in succession, therefore sequentially, for example, by pipetting or in some other way, especially therefore externally or from the outside. Thus, a common fill opening especially for different liquids is formed and can be used. Unwanted mixing of the different liquids in the receiving chamber and sequential transfer into the preferably parallel connected reaction chambers are thus enabled by the receiving chamber being emptied each time before receiving a new liquid, especially automatically by capillary forces and/or by centrifugal forces.

In particular, it thus becomes possible to suitably prepare several or all reaction chambers with minimum effort, especially with especially few pipetting processes, therefore for example, to immobilize a reaction, such as an antibody or the like, in the reaction chambers. Alternatively or in addition, the common receiving chamber assigned to the reaction chambers allows execution of a detection reaction, for example, by supplying the corresponding liquids with an enzyme, the substrate or the like with minimum pipetting cost.

Another aspect of this invention is that a detection or test chamber is assigned to the reaction chambers and the detection reactions which proceed in the reaction chambers preferably enzymatically by an immobilized enzyme can be stopped, that the liquid located in the reaction chambers is transferred into the assigned test chamber—preferably by pressure, capillary and/or centrifugal forces. This transfer takes place especially at the same time for several or all reaction chambers, so that the detection reactions can also be stopped at the same time in these reaction chambers. The testing, especially the detection of the detection substrate formed in the respective liquid or the like can, if necessary, take place in succession in the test chambers. Thus, much greater accuracy is enabled when especially enzymatically running, and accordingly, time-critical detection reactions are stopped.

Other advantages, features, properties and aspects of this invention will become apparent from the following description of preferred embodiments using the drawings.

DETAILED DESCRIPTION OF PREFERRED EMBODIMENTS

In the figures, the same reference numbers are used for the same or similar parts, the corresponding or comparable properties and advantages being achieved even if a repeated description is omitted.

Figure 1:
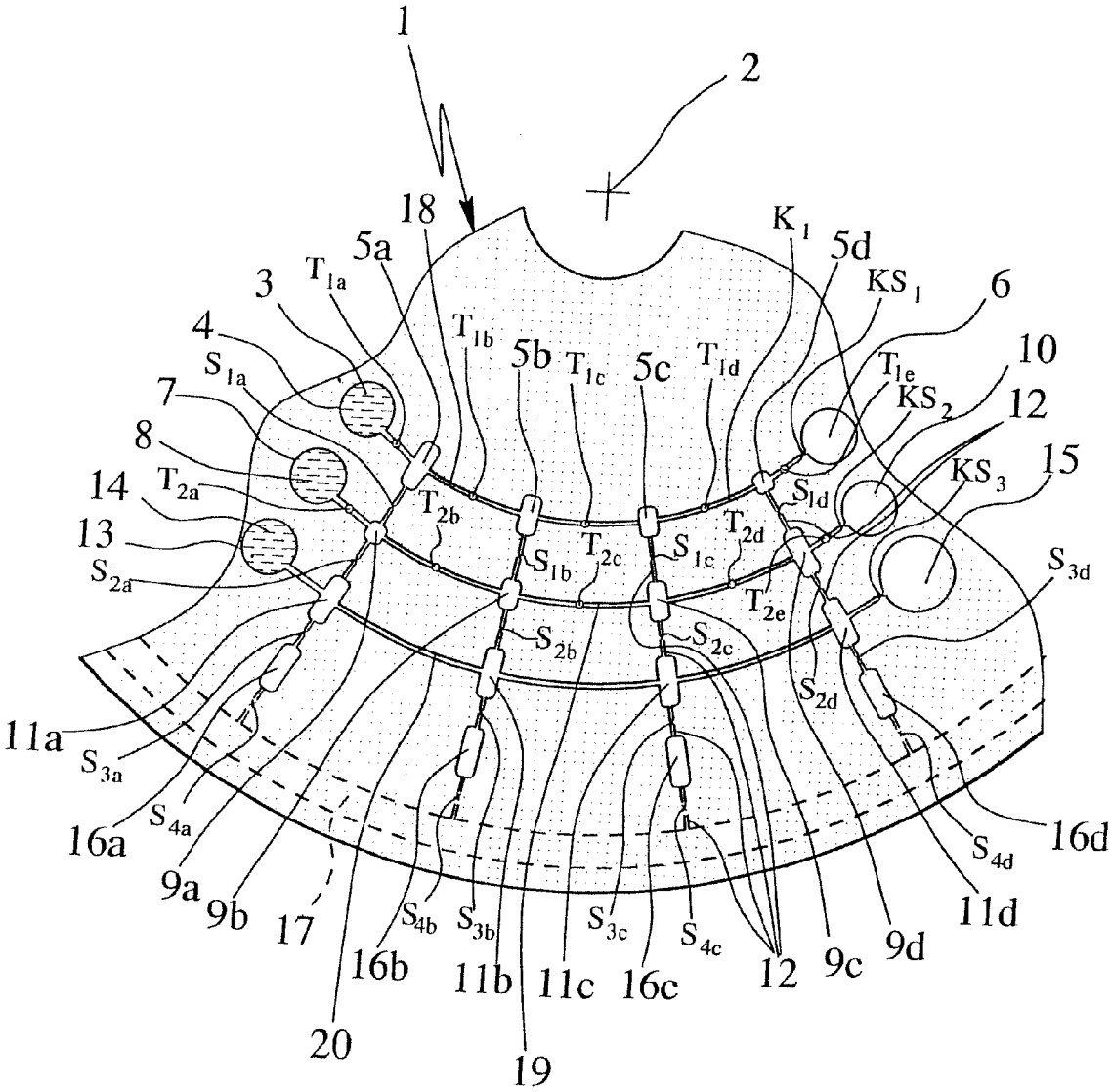
FIG. 1 is a plan view of part of the device in accordance with the invention according to the first embodiment, not to scale.

FIG. 1 shows a device 1 in accordance with a first embodiment of the invention, not to scale, that is especially a microfluidic system which, preferably, has the shape of a round disk, preferably a compact disk (CD) or the like, and accordingly, can be rotated around an axis of rotation 2 for producing centrifugal forces. However, other configurations and embodiments are also possible.

The device 1 of the invention is used to test a sample liquid 3, especially by means of the ELISA (enzyme-linked immunosorbent assay) process. The following description is therefore directed essentially at the use or implementation of the ELISA process, and if necessary, supplementary or alternative measures or process steps can be carried out. However, the device 1 in accordance with the invention or the process in accordance with the invention can also be used, fundamentally, for other tests or processes.

FIG. 1 shows the sample liquid 3 immediately after addition to the first, common receiving chamber 4. Several first metering chambers 5 (in the illustrated embodiment four first metering chambers 5*a* to 5*d*) are connected to the first receiving chamber 4 by the corresponding channels or the like (in the illustrated embodiment by channel 18) and are preferably located in a series in the peripheral direction.

The sample liquid 3 flows from the first receiving chamber 4 into the connected first metering chambers 5, the air and/or excess sample liquid 3 being able to continue to flow into an optional first collecting chamber 6. Therefore, the channel 18 connects the first receiving chamber 4 to the first collecting chamber 6. FIG. 1 shows the device 1 in the state immediately after the addition of the sample liquid 3 to the first receiving chamber 4, therefore, before the sample liquid 3 flows into the first metering chambers 5.

The device has a second common receiving chamber 7 for holding a dilution liquid 8. Several second metering chambers 9 (in the illustrated embodiment four second metering chambers 9*a* to 9*d*, are connected to the second receiving chamber 7, and in the illustrated example, are likewise arranged in a row and at least essentially parallel to the first metering chambers 5. The dilution liquid 8 flows via the channel 19 into the second metering chambers 9. Excess dilution liquid 8 can flow, if necessary, into an optional second collecting chamber 10. The channel 19 preferably connects the second receiving chamber 7 to the second collecting chamber 10. FIG. 1 shows the device 1 in the state immediately after adding the dilution liquid 8 to the second receiving chamber 7, therefore before the dilution liquid 8 fills the second metering chambers 9 and the associated channels or the channel 19, and optionally, the collecting chamber 10.

The metering chambers 5, 9 are preferably made designed so that the metering chambers 5, 9, and optionally, the channels 18, 19 are filled completely with the liquids 3, 8, without the inclusion of gas or air, for example, by guide elements (not shown). Displaced air can escape via collecting chambers 6, 10 which are preferably open and/or via ventilation openings (not shown) and which are assigned especially to the channels 18, 19 and/or the metering chambers 5, 9.

The reaction chambers 11 (according to the number of the first and second metering chambers 5*a* to 5*d* and 9*a* to 9*d* in the illustrated example, therefore four reaction chambers 11*a* to 11*d*) are assigned to the first and second metering chambers 5, 9, and in the illustrated example, are located preferably in a row parallel to the first and second metering chambers 5, 9 and/or radially outside of the first and second metering chambers 5, 9, with respect to the axis 2 of rotation.

The first and second metering chambers 5, 9 are preferably assigned in pairs to one another and each to a reaction chamber 11, each pair being fluidically connected to the assigned reaction chambers 11 by the corresponding, especially radially running, preferably channel-like connections 12, for example, therefore, the first metering chamber 5*b* and the second metering chamber 9*b* to the assigned reaction chamber 11*b*. The letters a to d in this example, therefore, indicate the assignment of the individual chambers 5, 9, 11 and 16. Accordingly, liquid transfer, especially for dilution, mixing and/or reaction takes place in this manner.

In the illustrated example, the first metering chambers 5, 9 are filled with the sample liquid 3 and the dilution liquid 8 preferably automatically based on pressure and capillary forces, especially when the liquid 3 or 8 is being added to the assigned receiving chambers 4, 7 by means of a pipette or the like (not shown) and as a result of the pressure exerted on the liquid 3, 8. However, also other forces, optionally even centrifugal forces, can be used depending on the arrangement and execution, alternatively or in addition thereto.

Then, the volumes of the sample liquid 3 which are present in the first metering chambers 5 and the volumes of the dilution liquid 8 which are present in the second metering chambers 9 can be transferred by the corresponding centrifugal forces (caused by the corresponding rotation of the device 1 around the axis of rotation 2) into the respectively assigned reaction chamber 11, in the illustrated example, therefore, radially, the sample liquid 3 and the dilution liquid 8 being mixed. However, to transfer the indicated volumes into the reaction chambers 11, in addition or alternatively, also other forces act, for example, compressive forces, capillary forces or the like.

The first metering chambers 5 and/or the second metering chambers 9 vary in their volumes. The volumes are selected such that different dilution ratios of the sample liquid 3 are achieved in the reaction chambers 11.

Especially, both the volumes of the first metering chambers 5 and also the volumes of the second metering chambers 9 vary. For example, a first metering chamber 5d with a small volume is assigned a second metering chamber 9*d* with a large volume and vice versa. In the illustrated example, this is achieved in that the volumes of the first metering chambers 5 increase or decrease in the peripheral direction and the volumes of the second metering chambers 9 conversely decrease or increase in this peripheral direction. This allows a dilution series with a large dilution range—therefore, especially from a low dilution ratio to a large dilution ratio, for example, from 1:1 to 1:1000—and/or a very space-saving, compact arrangement of the metering chambers 5, 9 with the correspondingly low space or area requirement.

Especially preferably, the sums of the volumes of the first and second metering chambers 5*a* and 9*a*, 5*b* and 9*b*, 5*c* and 9*c* and 5*d* and 9*d* which are assigned in pairs to one another are at least essentially the same. In this way, in addition to an especially compact structure, the result can be that the individual volumes of variously diluted sample liquid 3 are the same and the reaction chambers 11 and possibly other downstream chambers or the like can be made uniformly the same size.

In the previous and in the following description, the focus is on the respective volumes of the metering chambers 5, 9. In order to obtain defined dilution ratios, accurately defined volumes are necessary. So that, in the transfer of the sample liquid 3 and the dilution liquid 8 from the first and second metering chambers 5, 9, into the assigned reaction chambers 11, only defined volumes of the liquids 3, 8 are present, transferred and mixed, there are valve means, barriers or liquid stops (not shown), for example, ventilation openings and/or the like assigned to the connections 12, the channels 18, 19.

In the illustrated embodiment, the first separation points $T_{1a}$ to $T_{1e}$ for the liquid 3 are formed in the first channel 18, especially between the first receiving chamber 4 and the first metering chamber 5*a*, between the individual metering chambers 5 and between the last metering chamber 5*d* and the first collecting chamber 6. Accordingly, second separation points $T_{2a}$ to $T_{2e}$ for the liquid 8 are formed in the second channel 19, especially between the second receiving chamber 7 and the following second metering chamber 9*a*, between the second metering chambers 9 and between the last metering chamber 9*d* and the second receiving chamber 10. However, the first and second separation points T can be formed alternately or additionally at the transition to the individual chambers and/or at other suitable points.

Furthermore, in the illustrated embodiment preferably the channel stops $KS_1$, $KS_2$ in the channels 18, 19 are formed between the last separating point $T_{1e}$, $T_{2e}$ and the respective collecting chamber 6, 10 or at the transition to the respective collecting chamber 6, 10 in order to form such a flow resistance for the respective liquid 3, 8, such that, when filled, first of all, the first and second metering chambers 5, 9 are completely filled with the respective liquid 3, 8 before it can flow on into the assigned collecting chambers 6, 10.

In the illustrated embodiment, preferably, the first liquid stops $S_{1a}$ to $S_{1d}$ and the second liquid stops $S_{2a}$ to $S_{2d}$ in the preferably radially running connections 12 are located between the respective first metering chambers 5 and the second metering chambers 9, and the second metering chambers 9 and the reaction chambers 11. These liquid stops S can, however, also be formed alternately or additionally at the transitions to the respective chambers.

The first liquid stops $S_1$ prevent the sample liquid 3 from filling the second metering chambers 9 in an unwanted manner when the first metering chambers 5 are being filled. Conversely, the first liquid stops $S_1$ also prevent the dilution liquid 8 from being able to fill the first metering chambers 5 in an unwanted manner when filling the second metering chambers 9 and from being able to displace the sample liquid 3 out of the first metering chambers 5. However, to do this, there are also additional liquid stops which are not shown, for example, at the transition of the connections 12 in the respective second metering chambers 9.

The second liquid stops $S_2$ prevent the dilution liquid 8 from flowing in an unwanted manner into the reaction chambers 11, by which defined metering would no longer be possible, when the second metering chambers 9 are being filled.

The channel stops KS and the liquid stops S are made, or are matched to the liquids 3, 8 and to the pressures occurring during filling especially by means of pipettes or the like which are not shown, such that the first and second liquid stops $S_1$, $S_2$ during filling of the first and second metering chambers 5, 9, cannot be passed with the liquids 3, 8, but only upon later desired transfer of the individual volumes of liquid 3, 8 from the metering chambers 5, 9 into the reaction chambers 11, especially only with the corresponding rotation of the device 1 or only with the corresponding centrifugal forces. The liquid stops S are made here such that the second liquid stops $S_2$ in front of the first liquid stops $S_1$ can open and can be overcome. This can also be achieved with the same or similar embodiment and property of the first and second liquid stops S in that for the second liquid stops $S_2$ which lie radially farther to the outside as compared to the first liquid stop $S_1$, greater centrifugal forces occur or act than in the first liquid stops $S_1$.

The separation points T and liquid stops S lead to defined volumes of the liquid 3, 8 which are mixed with one another. When the liquid volumes are transferred out of the first and second metering chambers 5, 9 into the reaction chambers 1, the liquid 3, 8 detaches at the separation points T and then flows into the assigned reaction chambers 11 via the respective, especially radial connection 12. Accordingly, the liquid volumes assigned, for example, to the second metering chamber 9*b* are determined or fixed by the two second separation points $T_{2b}$, $T_{2c}$ and the two liquid stops $S_{1b}$, $S_{2b}$. The volume of the sample liquid 3 which has been metered and which is to be transferred is limited, for example, to the first metering chamber 5*b* by the two separation points $T_{1b}$, $T_{1c}$ and by the liquid stop $S_{1b}$. This applies accordingly to the other liquid volumes of the other metering chambers 5, 9.

Preferably, the separation points T are formed by the corresponding vents (not shown). The liquid stops S and/or the channel stops KS are preferably formed by a corresponding constriction, sudden widening of the cross section and/or modification of the wetting behavior, so that the respective liquid 3, 8, 14 cannot or cannot easily overcome the respective stop S, KS. Rather, especially a predetermined centrifugal force, compressive force or the like, which is different as necessary for the individual stops S, KS, are needed to be able to overcome the respective stop S, KS.

With respect to the required and/or possible designs, to ensure defined volumes and to make available suitable structures and arrangements for dividing and/or mixing of liquid amounts, reference is made to the initially named prior art which is introduced herewith in this regard in addition or alternatively as a disclosure.

The above explained "parallel dilution" allows production of a dilution series in a single step so that in all cases only slight dilution errors occur. In particular, the problem of addition of individual errors which occurs in sequential dilution which was conventional in the past can be avoided.

In each reaction chamber 11, then, the desired reaction and especially several desired reactions can proceed or can be carried out, which will be explained in detail later. To carry out the ELISA process, the reaction chambers 11 are preferably prepared first before supplying the diluted sample liquid 3. This preparation takes place especially before adding the same liquid 3 to the first receiving chamber 4 and the dilution liquid 8 to the second receiving chamber 7 and is explained below.

The device 1 preferably has one, especially only a single common receiving chamber 13, for receiving a liquid 14, especially sequential reception of various liquids 14, such as a reaction liquid, a washing liquid, a blocking and fixing liquid, a substrate liquid, or the like. The reaction chambers 11 are connected to the third receiving chamber 13 so that, especially by pressure, capillary and/or centrifugal forces, a liquid 14 which is added to the receiving chamber 13 can flow via the corresponding channels or the like into the reaction chambers 11. In the illustrated example, this flow is via a chamber 20 which runs preferably in the peripheral direction and/or parallel to the channels 18, 19. Overflowing and/or displaced liquid 14 is preferably captured in an optionally provided, third collecting chamber 15, an optimum channel stop $KS_3$ being able to provide for the liquid 14 to completely fill the reaction chambers 11 first before it flows into the third collecting chamber 15.

In particular, the device 1 is made such that the third receiving chamber 13 is first emptied or can be emptied completely again before another liquid 14 is supplied to the third receiving chamber 13, for example, by pipetting. The emptying of the third receiving chamber 13 can be achieved, for example, in that, after filling the third receiving chamber 13 with a liquid 14, it flows through automatically by capillary forces into the reaction chambers 11 and optionally the third collection chamber 15 until the third receiving chamber 13 is completely emptied. In addition or alternatively, this can be achieved by centrifugal forces, especially for a radial gradient (increase of the radial distance to the pivot 2) of the channel 20 to the third collecting chamber 15, and the corresponding rotations of the device 1, and/or other forces.

In addition, the reaction chambers 11, if necessary, can be first emptied again before a new liquid 14 is added to the third receiving chamber 13 and this new liquid 14 flows into the reaction chambers 11. The previous emptying of the reaction chamber 11 then takes place preferably by centrifugal forces, valve means (not shown), or the like, in order to enable controlled emptying of the reaction chambers 11.

To prepare the reaction chambers 11 for the ELISA process, especially first a liquid 14 with a reagent, preferably an antibody, is first added to the third receiving chamber 13 and routed into the reaction chambers 11 in order to immobilize the reagent in the reaction chambers 11, especially to bind the antibody in the correspondingly prepared reaction chambers 11 or to coat the reaction chambers 11 with the antibody.

After a certain incubation or reaction time, the reaction chambers 11 are flushed with a washing liquid which is added as the next liquid 14 into the third receiving chamber 13 in order to remove the unbound reagent.

With another liquid 14 if necessary blocking of the still free, therefore especially binding sites not occupied by antibodies follows in order to block later, undefined binding of other reagents, or fixing of the immobilized reagent or immobilized antibodies in the reaction chambers 11.

After optionally repeated flushing with a washing liquid and optionally emptying, then the reaction chambers 11 are prepared in order to hold the diluted sample liquid 3—therefore, the sample liquid 3 and the dilution liquid 8 from the assigned first and second metering chambers 5, 9.

After transferring the sample liquid 3 together with the dilution liquid 8 into the reaction chambers 1, the actual detection reaction or a first reaction can take place for testing the sample liquid 3. An analyzed substance contained in the sample liquid 3 in the illustrated embodiment can bind especially to the immobilized reagent, especially the immobilized antibody. After a preferably determined or defined reaction time, the unbound analyzed substance is washed or flushed out of the reaction chambers 1, especially by one-time addition of a washing liquid 14 to the third receiving chamber 13 in order to displace the existing liquids 3, 8 out of the reaction chambers 1, and/or by centrifugal or other forces.

Then, another liquid 14 which contains especially an enzyme bound to a detection antibody is supplied to the reaction chambers 11 by this liquid 14 being supplied, in turn, to the third receiving chamber 13. The detection antibody is made such that, together with the enzyme, it binds on the complexes which are formed from the immobilized antibodies and the analyzed substance in the reaction chambers 11.

Unbound antibodies and enzymes are then flushed out of the reaction chambers 11 in a washing step by preferably a one-time supply of another washing liquid 14.

Finally, a substrate solution, as another liquid 14, is preferably, in turn, supplied to the reaction chambers 11 via the third receiving chamber 13. The substrate is converted or modified by the enzymes in the reaction chambers 11 in an enzymatic detection reaction so that a subsequently detectable detection substrate, especially a fluorescing or other dye or the like, is formed. The stopping of the detection reactions in the reaction chambers 11 and subsequent testing are explained below.

The supply of different liquids 14, which takes place preferably exclusively via the common third receiving chamber 13 by sequential supply of liquids 14 allows very rapid and simple preparation of the reaction chambers 11 and/or guidance of the reactions in the reaction chambers 11, the pipetting cost, the necessary washing steps and/or the required liquid amounts being greatly reduced as compared to the prior art—especially as compared to the conventional ELISA process in an open pipetting plate.

In the past, the already named, especially enzymatic or catalytic detection reactions proceeding in the reaction chambers 11 were stopped by adding an acid, a base or other stopping solution or the like, for example, by deactivation of the enzyme and catalytic reaction. This is fundamentally also possible in the device 1 in accordance with the invention.

However, especially preferably, the stopping of the detection reactions takes place by separation of the liquid with the substrate and detection substrate by the (immobilized) enzymes, reaction catalysts or other reaction partners and/or by means of additionally provided testing chambers 16 by the liquid located in the reaction chambers 11 being transferred with the substrate and detection substrate into the assigned testing chamber 16 to stop the detection reactions each time. This transfer takes place preferably for several or all reaction chambers 11 at the same time, so that the detection reactions are stopped at the same time. In particular, the indicated transfer or stopping takes place by centrifugal forces by the device 1 being rotated accordingly. However, transfer is also possible in addition or alternatively by other forces, for example, pressure or capillary forces, by means of the corresponding valves or the like.

The indicated transfer of the liquids from the reaction chambers 11 in which the enzyme and/or other reagents necessary for the detection reactions are immobilized, into the test chambers 16 enables very simple and high-quality simultaneous stopping of the detection reactions so that, as compared to the prior art, a much more defined process sequence, and thus, a much more accurate determination of the analyzed substance are enabled.

After transfer of the liquids with the detection substrate into the test chambers 16, sequential testing or detection of the detection substrate in the test chambers 16—especially optically, for example, by measuring fluorescence—can take place. From the acquired values and with consideration of the different dilution ratios, an extremely accurate, especially quantitative determination of the analyzed substrate in the sample liquid 3 can take place.

In addition or alternatively, the reaction chambers 11 can also be assigned an optional collecting channel 17, which is shown by the broken line in FIG. 1, and which is connected, for example, via the test chambers 16 and the corresponding, preferably radial connections 12 to the reaction chambers 11, in order to receive liquid(s) from the reaction chambers 11 to empty the reaction chambers 11, especially when the reaction chambers 11 are being emptied by centrifugal forces by the corresponding rotation of the device 1. These liquids can then be discharged through the test chambers 16 or through directing connections or the like which are not shown into the collecting channel 17. This emptying of the reaction chambers 11 can take place, for example, for removal of liquids 3, 8 and/or 14 before supplying a new liquid 14 to the reaction chambers 11.

In the illustrated embodiment, preferably three liquid stops $S_{3a}$ to $S_{3d}$ are formed in the (radial) connections 12 between the reaction chambers 11 and test chambers 16. The third liquid stop $S_3$, especially together with the second liquid stops $S_2$, can prevent unwanted escape of the liquid 14 into other regions so that the liquids 14, in the desired manner, can be diverted or emptied, for example, only into the third collecting chamber 15, or if necessary, when overcoming the third liquid stops $S_3$ via the test chambers 16, and optionally, the fourth liquid stops $S_4$ into the collecting channel 17.

The third liquid stops $S_3$ provide especially for defined holding of the volumes of liquids 3, 8 which have been metered or transferred into the reaction chambers 11, and therefore, prevent uncontrolled and unwanted flow out of the reaction chambers 11.

In addition, if necessary, in the channel 20 or in other connections between the reaction chambers 11 and/or to the third receiving chamber 13 or third collecting chamber 15 there can be separation points or liquid stops (not shown) in order to be able to prevent unwanted transfer of diluted sample liquid 3 out of the reaction chamber 11 into an adjacent reaction chamber 11—for example, for mixing by acceleration and slowing down.

In addition or alternatively, the channel 20 and especially its sections which extend between the individual reaction chambers 11, also deviating from the course with an at least essentially constant distance or radius relative to the pivot 2, can have a different course which diverges in the radial direction in order to prevent unwanted transfer of the diluted sample liquid 3 between individual reaction chambers 11. The corresponding also applies to the other channels 18, 19, and the respective channel sections between the metering chambers 5, 9.

Preferably, fourth liquid stops $S_{4a}$ to $S_{4d}$ are located in the radial connections 12 between the test chambers 16 and the optional collecting channel 17 in order to prevent undefined outflow or diversion of liquid from the test chambers 16.

The third and fourth liquid stops $S_3$, $S_4$ can, in turn, also be formed, as required, at the transitions from the reaction chambers 11, 16 to the respective connections 12.

With respect to parallel dilution, it is noted that, preferably, in a single dilution step—therefore with parallel dilution—3 to 20, especially roughly 10 dilutions or different dilution ratios are produced. Of course, also several parallel dilutions can take place at the same time on the device 1. Accordingly, the device 1 can, if necessary, also have several arrangements, as is shown in FIG. 1.

A second embodiment of the device 1 in accordance with the invention and of the process in accordance with the invention is explained below using FIG. 2, with the following statements being limited solely to important differences relative to the first embodiment. Other advantages, aspects and properties will therefore become apparent in the corresponding manner as in the first embodiment.

Figure 2:
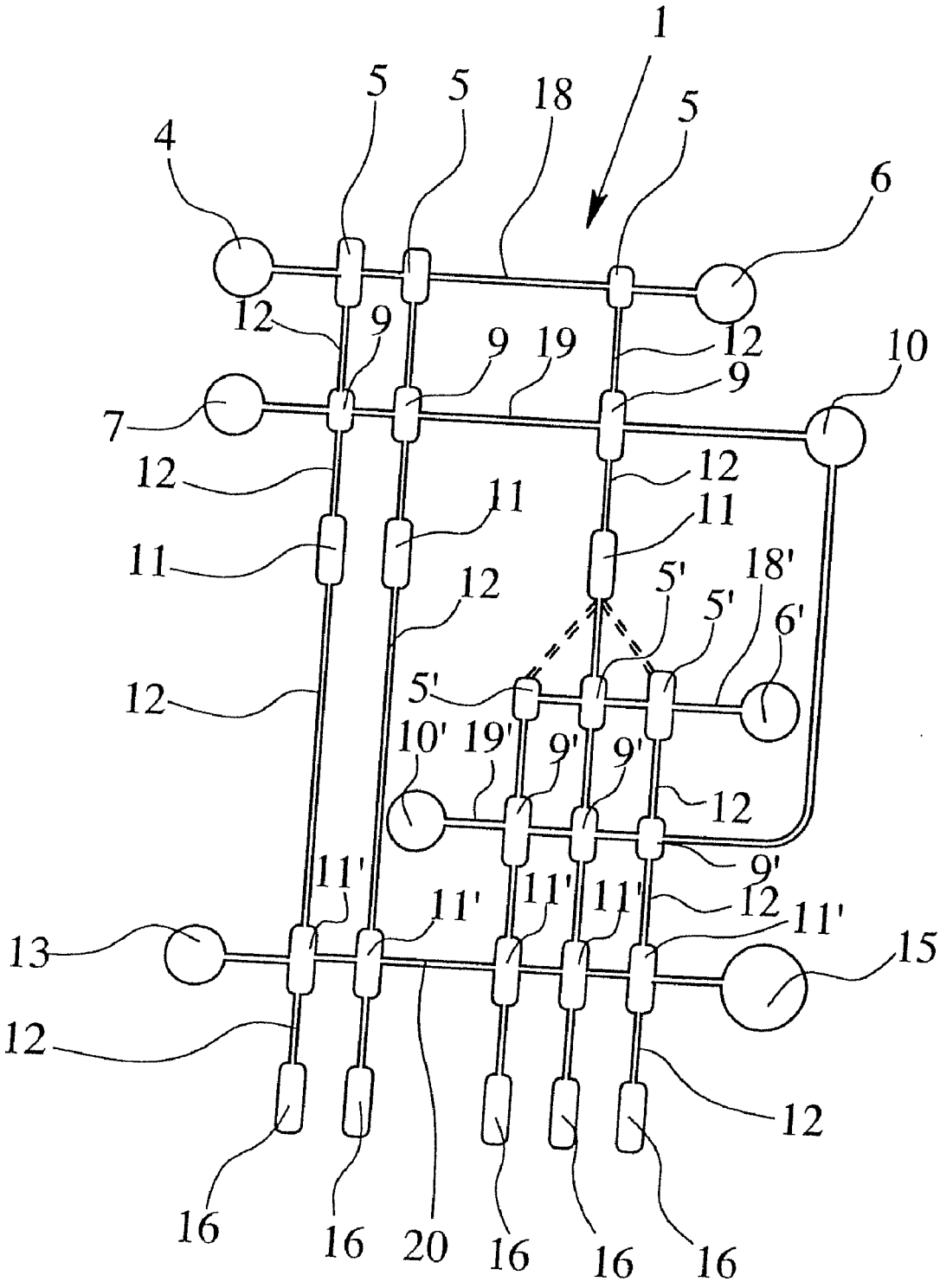
FIG. 2 is a schematic representation of part of the device in accordance with the invention according to the second embodiment.

In the representation as shown in FIG. 2, the preferably provided curvature for the preferably provided ring structure for arrangement on a round disk, such as a CD or the like, is omitted, in order to enable better clarity. Furthermore, the representation as shown in FIG. 2 is likewise not to scale. In particular, the illustrated lengths, widths, size ratios and the like do not correspond to the absolutely necessary or preferred ratios. This is likewise the case as shown in FIG. 1.

In FIG. 2, moreover, the liquids 3, 8, 14 are not shown for reasons of simplification. However, the statements in this respect in connection with the first embodiment and also with respect to the other process sequence apply accordingly to the second embodiment shown in FIG. 2. Furthermore, for reasons of simplification, the optional collecting channel 17 is omitted in FIG. 2.

Furthermore, for reasons of simplification, FIG. 2 does not show any separation points T, liquid stops S and channel stops KS. The explanations and arrangements in this respect for the first embodiment, however, apply to the second embodiment accordingly or in addition.

In the second embodiment, in contrast to the first embodiment, after parallel dilution , a further dilution, therefore underdilution, takes place. This further dilution is performed, in turn, as a parallel dilution for the illustrated example shown in FIG. 2. In the illustrated example, simply one further dilution of only a sample liquid which has already been diluted once from only a reaction chamber 11 takes place. However, if necessary, also underdilution or further dilution for several or all reaction chambers 11 can be provided.

Further, parallel dilution takes place essentially like the already above explained parallel dilution by means of the first and second metering chambers 5, 9 and the downstream reaction chambers 11. For further parallel dilution, therefore, additional first metering chambers 5', additional second metering chambers 9' and additional reaction chambers 11' are provided. The additional metering chambers 5', 9', preferably, have the corresponding volumetric ratios—for especially correspondingly reduced absolute volumes—as the first and second metering chambers 5, 9.

The supply of sample liquid already diluted once into the additional first metering chambers 5' takes place from the upstream reaction chambers 11 which, in the case of further dilution, constitute actually only one mixing chamber. In turn, the dilution liquid 8, especially the excess dilution liquid 8 for the first dilution, is supplied to the additional second metering chambers 9', especially the excess dilution liquid 8 for the first dilution, for example, via the collecting chamber 10.

The transfer of the individual liquid volumes into the assigned additional reaction chambers 11' takes place, in turn, preferably by centrifugal forces. However, alternatively or in addition, also other forces, especially pressure and/or capillary forces, can act, or valves or the like are used.

But, for further dilution, also another or additional dilution liquid can be supplied, again separately, to the addition second metering chambers 9' via an additional receiving chamber (not shown).

If further dilution takes place only partially, as shown in FIG. 2, preferably but not necessarily, those reaction chambers 11 with contents which are not further diluted are each assigned additional reaction chambers 11 which are located especially on the corresponding periphery as the additional reaction chambers 11' which are used for further dilution in order to ensure or facilitate simultaneous testing, especially bonding of the analyzed substance to the immobilized reagent, for all dilution stages.

Optionally, there can also be an additional first collection chamber 6' which is connected to the additional first metering chambers 5' to hold the excess sample liquid 3. Optionally, an additional second collecting chamber 10' can also be connected upstream and is located on the additional second metering chambers 9' to hold the excess dilution liquid 8.

Figure 3:
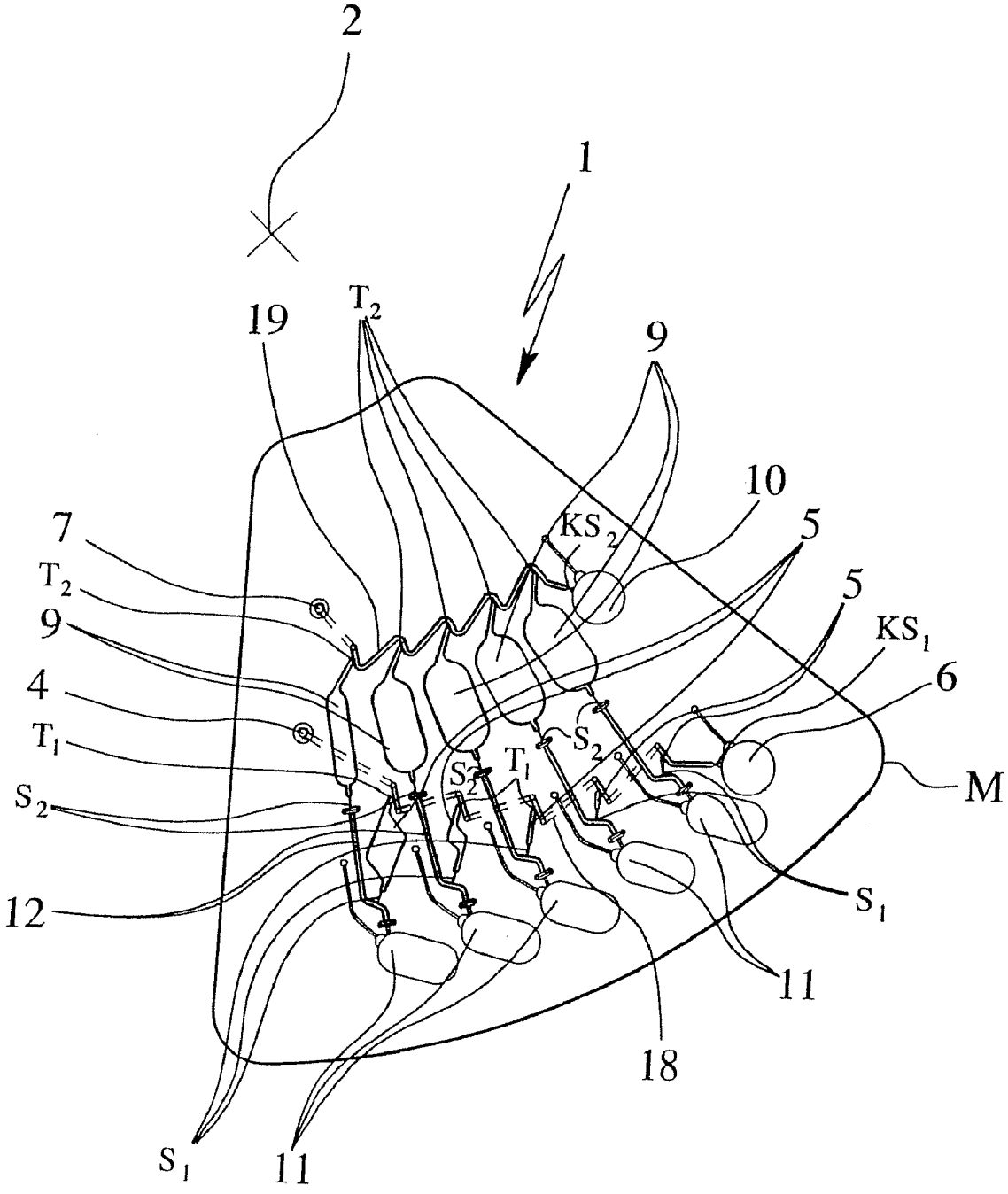
FIG. 3 shows part of the device in accordance with the invention according to the third embodiment, not to scale.

A third embodiment of the device in accordance with the invention 1 and of the process in accordance with the invention is explained below using FIG. 3, the following statements being limited only to important differences compared to the first and second embodiments. The existing explanations therefore apply in addition or accordingly.

In the third embodiment, the first metering chambers 5 are connected parallel to a first, especially common channel 18 which leads from the first receiving chamber 4 to the first collecting chamber 6. This has the advantage that more rapid filling of the first metering chambers 5 with sample liquid 3 is possible since they can be filled in parallel, therefore simultaneously. In particular, filling by pressure, for example, by attaching a pipette (not shown) or the like to the first open receiving chamber 4 takes place, the (partial) filling of the first collecting chamber 6 which takes place in this connection not being critical with the corresponding dimensioning.

The first channel 18 is emptied into the first collecting chamber 6 after filling the first metering chamber 5—especially by capillary and/or centrifugal forces—before transfer of the sample liquid 3 out of the first metering chambers 5 into the assigned reaction chambers 11. This leads to especially accurate metering since this defined "detachment" of the sample liquid 3 at the transitions (separation points $T_1$) from the channel 18 to the individual first metering chamber 5 or corresponding connections is achieved. This enables especially accurate metering which then lead to the correspondingly accurate dilution series with subsequent mixing of the dilution liquid 8 and especially in the ELISA process to very accurate quantitative results.

The second metering chambers 9 are preferably connected in the corresponding manner in parallel to a second, especially common channel 19 which connects the second receiving chamber 7 to the second collecting chamber 10. Accordingly, the second metering chambers 9 can be filled more quickly with the dilution liquid 8. Preferably, filling with the dilution liquid 8 likewise follows by pressure, especially by attachment of a pipette or the like (not shown).

Furthermore, the second channel 19, after filling the second metering chambers 9, is also preferably completely emptied into the second collecting chamber 10, especially by capillary and/or centrifugal forces before the dilution liquid 8 is transferred out of the second metering chambers 9 into the assigned reaction chambers 11. This, in turn, yields very accurate metering since the dilution liquid 8 at the transitions (separation points $T_2$) from the channel 19 to the metering chambers 9 or the corresponding connection detaches in a defined manner, as already explained above, for the sample liquid 3 and the first metering chambers 5. Accordingly, this enables especially accurate dilution series and especially very accurate quantitative tests according to the ELISA process or in some other way. The first and second channels 18, 19, are preferably likewise emptied.

The separation points T are formed especially by the corresponding constrictions and/or kinks in order to ensure the desired defined detachment of the liquid.

The parallel connection of the first metering chambers 5 to the first channel 18 and/or of the second metering chambers 9 to the second channel 19, which parallel connection is provided in the third embodiment allows, as already explained, especially rapid and parallel filling of the chambers 5, 9, and can also be accomplished, if necessary, independently of other aspects and features of these embodiments.

The channels 18, 19, in turn, preferably have channel stops $KS_1$, $KS_2$, for the respective collecting chamber 6, 10, in order to ensure that, first of all, the respective metering chambers 5, 9 are completely filled before the corresponding liquid 3, 8 can continue to flow into the pertinent collecting chamber 6, 10. In particular, the channels stops KS are designed such that they can be overcome by the respective liquid 3, 8 from the pressure for supply—for example, by a pipette, and with which the respective liquid is supplied to the assigned receiving chamber 4, 7—only after complete filling of the assigned metering chambers 5, 9. Thus, complete filling of the metering chambers 5, 9 can be ensured with the respective liquid 3, 8.

In order to enable or support complete emptying, the channels 18, 19 run preferably largely in a straight line or with only minor offsets or kinks and/or preferably without V-shaped or U-shaped arcs. In order to enable or support complete emptying, the channels 18, 19, alternatively or additionally, have preferably a radial gradient—especially between the respective start and end or the respective receiving chamber 4, 7 and collecting chambers 6, 10, so that the centrifugal forces which rise with increasing radius lead to the desired emptying of the channels 18, 19 when the device 1 rotates accordingly.

In the third embodiment, the first metering chambers 5 and second metering chambers 9 assigned to one another are not connected in series, as in the first or second embodiment (the sequence can be freely selected) or are connected in series to the assigned reaction chambers 11, but are connected preferably parallel or quasi-parallel to the assigned reaction chambers 11. A "quasi-parallel" connection, which is explained below using FIG. 3, is especially preferred.

The second metering chambers 9 are connected to the assigned reaction chambers 11 via connections 12 which preferably run at least essentially radially. The second liquid stops $S_2$ prevent uncontrolled outflow of the dilution liquid 8 out of the second metering chambers 9 via the connections 12 into the reaction chambers 11.

The first metering chambers 5 are now, for their part, connected to the assigned connections 12, preferably via first liquid stops $S_1$, especially after the second liquid stops $S_2$. The first liquid stops $S_1$ are formed, for example, by a corresponding constriction or sudden cross-sectional widening so that the sample liquid 3 from the first metering chambers 5—preferably also when an angular velocity or centrifugal force is reached which leads to a transfer of dilution liquid 8 out of the second metering chambers 9 into the assigned reaction chambers 11—is not transferred or not easily transferred into the assigned reaction chambers 11 via the connections 12. Rather, preferably outflow-side wetting, especially of the liquid stops $S_1$, by the dilution liquid 8 is necessary. Only then can the sample liquid 3 overcome the liquid stops $S_1$ or other connections toward the connections 12 and together with the dilution liquid 8 then flow into the assigned reaction chambers 11. The lateral or parallel feed of the sample liquid into the dilution liquid flows leads to first mixing or to better mixing so that then very good intermixing can be achieved in the reaction chambers 11.

The preferred special formation (tapering) of the liquid stops S can, if necessary, also be omitted. Alternatively, instead of this, valve means (not shown) can be used.

Furthermore, it is also possible for transfer of the dilution liquid 8, on the one hand, from the second metering chambers 9, and on the other hand, transfer of the sample liquid 3 out of the first metering chambers 5 to take place more or less at the same time, especially when a certain angular velocity or centrifugal force is reached or exceeded. In this case, likewise a (first) intermixing of the liquids 3, 8 is achieved by adding the sample liquid 3 to the dilution liquid flow in the connections 12.

If necessary, supply can also take place in reverse, therefore the dilution liquid 8 can be fed into the sample liquid flows in the connections 12. The aforementioned statements then apply accordingly.

In the third embodiment, it is not decisive whether the first liquid stops $S_1$ or the second liquid stops $S_2$ are overcome first by the respective liquid 3, 8, since, in both cases, good intermixing of the two liquids 3, 8 can be achieved, at least in the reaction chambers 11. Accordingly the third embodiment is a very durable system.

Another aspect of the third embodiment lies in that, for example, the channels 18, 19, but also other cavities, connections 12 and the like need not always be formed on one flat side of the carrier—especially not on the flat side in which the chambers 4 to 7, 9 to 11, 13, 15, and 16—in which the cavities, channels or the like are formed. Rather in FIG. 3, the sections indicated by the broken line are formed preferably on the bottom, while the solid cavities, channels and the like are preferably formed on the top or from the top. The top and bottom cavities, channels and the like are then connected to one another by the corresponding openings, holes or the like. This enables much greater freedom in the design of the device 1, especially with respect to the arrangement, configuration and connection of the chambers. The cavities, channels or the like formed preferably in the flat sides (top and bottom sides) are then covered on each flat side, preferably by a covering (not shown), for example, a film or disk, so that an at least more or less closed system is formed. Only the required openings, for example, for filling the chambers 4, 7, 13 and for ventilation or the like then constitute, optionally, even sealable openings to the vicinity.

In the third embodiment, the reaction chambers 11 are not shown to scale. Furthermore, it should be noted that the volumes of the individual chambers can also vary to a great degree depending on the depth of the chambers. Furthermore, if necessary, of course, also test chambers 16 can be connected to the reaction chambers 11 according to the first or second embodiment.

Especially preferably, the device 1, according to one aspect of this invention which can be implemented independently of this embodiment, is composed of several, preferably segment-like modules M which can be arranged, for example, by means of an adapter or holder (not shown) in a disc-shaped configuration. This modular structure allows a combination of different tests as necessary. FIG. 3 shows only a single module M.

The individual features and aspects of the first, second and third embodiments can also be combined with one another as desired. Furthermore, individual aspects can also be used independently of these embodiments in other embodiments or applications.

The mixing of the sample liquid 3 with the dilution liquid 8—especially in the reaction chambers 11—can be promoted or achieved by slowing down and accelerating the rotation of the device 1.

The diameter of the device 1 or of the CD is preferably roughly 50 to 250 mm, especially roughly 125 mm. The thickness is preferably 1 to 6 mm, especially roughly 3 mm. The device 1 is preferably produced from a suitable plastic.

The depth or width of the microstructures, therefore especially of the described chambers, channels, connections and the like in the illustrated embodiment is preferably 20 to 1000 μm, especially roughly 200 μm.

All microstructures are preferably covered by a suitable cover (not shown) which is transparent. Only the receiving chambers 4, 7 and 13, optionally the collecting chambers 6, 10, 15 or the collecting channel 17 and/or other ventilation openings which are not shown or the like are made open to the outside. Thus, the evaporation losses can be minimized and accordingly small liquid volumes can be used with high accuracy.

The liquid volumes to be used are roughly 10 to 2000 μl, preferably roughly only 50 to 200 μl, per liquid.

The sum of the volumes of the first and second metering chambers 5, 9 which are assigned in pairs is preferably 1 to 100 μl, especially roughly 10 μl. The corresponding applies to the volumes of the reaction chambers 11 and the test chambers 16. In particular, the indicated sum and the respective volumes of the reaction chambers 11 and the test chambers 16 are the same.

In addition or alternatively to the dilution of the sample liquid 3 by the dilution liquid 8, also mixing of any liquids 3 and 8—therefore, for example, two liquids 3, 8 which react with one another—can also take place. In particular, instead of the dilution liquid 8, it can be a reaction liquid 8 or the like. Accordingly, the terms "sample liquid" and "dilution liquid" can be understood preferably also very generally as different liquids.

INDUSTRIAL APPLICABILITY

With the device 1 in accordance with the invention and the process in accordance with the invention, the ELISA process or some other process or some other test can be carried out in all commercial fields, very easily and very quickly and especially using very small liquid amounts, and thus, also economically. Furthermore, minimization of the required pipetting steps or other processes for supply of liquids is enabled. In particular, very accurate testing in the form of exact quantitative determination of an analyzed substance in the sample liquid is enabled.

The invention claimed is:

1. Device for testing a sample liquid, comprising:

a first common receiving chamber means for receiving the sample liquid, a plurality of first metering chamber means for holding the sample liquid which are connected to the first receiving chamber means, at least one second common receiving chamber means for holding a dilution liquid arranged parallel to said first common receiving chamber means, a plurality of second metering chambers means for exclusive metering of dilution liquid received from the second receiving chamber means, a plurality of reaction chambers, each of which is connected separately to said first and second metering chambers means wherein at least one of the first and second metering chamber means vary in their volumes, wherein at least one of the first and second metering chamber means are assigned to one another in parallel pairs, each pair being connected to an assigned reaction chamber so that the volumes of the sample liquid and dilution liquid which are contained in the first and second metering chamber means are transferred in separate parallel paths into the assigned reaction chambers and mixed, by which the sample liquid can be diluted with different dilution ratios.

2. Device as claimed in claim 1, wherein the volumes of the first metering chamber means, proceeding from the first receiving chamber means, increase or decrease and the volumes of the second metering chamber means decrease or increase oppositely to the volumes of the assigned first metering chamber means.

3. Device as claimed in claim 1, wherein the sums of the volumes of the first and second metering chamber means assigned to one another in pairs are the same.

4. Device as claimed in claim 1, wherein at least one of the reaction chambers is connected to a further chamber in which the diluted sample liquid in it is deliverable for further dilution.

5. Device as claimed in claim 1, wherein the first metering chamber means are connected in parallel to the first common receiving chamber means for receiving the sample liquid.

6. Device as claimed in claim 1, wherein the second metering chamber means are connected in parallel to the second common receiving chamber means for receiving the dilution liquid.

7. Device as claimed in claim 1, wherein every other metering chamber means is connected to an assigned reaction chamber via a connection and each assigned first metering chamber means is connected in parallel to the assigned reaction chamber via a liquid stop.

8. Device as claimed in claim 7, wherein the second metering chamber means and the assigned reaction chamber are arranged so that dilution liquid transferred between them will wet the liquid stop of the assigned first metering chamber means on an outflow side to support transfer of the sample liquid out of the first metering chamber means into the assigned reaction chamber.

9. Device as claimed in claim 1, wherein additional first metering chamber means for receiving diluted sample liquid are connected to at least one of the reaction chambers, and wherein additional second metering chamber means for receiving the dilution liquid are connected to at least one the second receiving chamber means, a collecting chamber assigned to the second metering chamber means for dilution liquid, and an additional supply of dilution liquid;

wherein at least one of the additional first metering chamber means and the second metering chamber means vary in their volumes, wherein the additional first and second metering chamber means are assigned to one another in pairs, and wherein each of the pairs of additional first and second metering chamber means is connected to an assigned additional reaction chamber so that the volumes of the already once diluted sample liquid and dilution liquid which are contained in the additional first and second metering chamber means can be transferred in pairs into the assigned additional reaction chamber and mixed, by which the already once diluted sample liquid can be further diluted with different dilution ratios.

10. Device as claimed in claim 9, wherein the volumes of the additional first metering chamber means and the volumes of the additional second metering chamber means vary oppositely to the volumes of the assigned additional metering chambers.

11. Device as claimed in claim 10, wherein the sums of the volumes of the additional first and second metering chamber means assigned respectively in pairs are the same.

12. Device as claimed in claim 1, further comprising a third receiving chamber means for receiving of at least one of a liquid with a reagent, an antibody, a washing liquid, and a blocking liquid.

13. Device as claimed in claim 1, further-comprising means for emptying the first receiving chamber means each time before a sample liquid is received again.

14. Device as claimed in claim 13, wherein at least two reaction chamber means are connected to the liquid receiving chamber means in a manner producing sequential reception of liquid by one of pressure, capillary and centrifugal forces.

15. Device as claimed in claim 14, wherein at least several of the reaction chamber means are connected to the liquid receiving chamber means in a manner enabling sequential reception of liquid(s) by pressure, capillary and/or centrifugal forces.

16. Device as claimed in claim 1, further comprising test chambers which are assigned to at least the reaction chambers and which form a means for stopping detection reactions which proceed in the reaction chambers by the liquids located in the reaction chambers being transferable thereto.

17. Device as claimed in claim 13, wherein the device has test chambers assigned to at least the reaction chamber means, said test chambers forming a means for stopping detection reactions which proceed in the reaction chamber means by the liquids located in the reaction chambers being transferable into the assigned test chambers.

* * * * *